US012404744B2

(12) United States Patent
Gonzalez

(10) Patent No.: US 12,404,744 B2
(45) Date of Patent: Sep. 2, 2025

(54) WIRELINE RETRIEVABLE OPENING PRONG

(71) Applicant: Halliburton Energy Services, Inc., Houston, TX (US)

(72) Inventor: Merced Gonzalez, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 278 days.

(21) Appl. No.: 18/119,214

(22) Filed: Mar. 8, 2023

(65) Prior Publication Data

US 2024/0301767 A1 Sep. 12, 2024

(51) Int. Cl.
*E21B 34/08* (2006.01)

(52) U.S. Cl.
CPC ..... *E21B 34/08* (2013.01); *E21B 2200/05* (2020.05)

(58) Field of Classification Search
CPC ..... E21B 34/08; E21B 2200/05; E21B 34/12; E21B 34/16; E21B 34/106; E21B 34/102
See application file for complete search history.

(56) References Cited

U.S. PATENT DOCUMENTS 4,962,813 A 10/1990 Welch
8,353,353 B2 * 1/2013 Reaux ..... E21B 34/10 166/373
2011/0155381 A1 6/2011 Reaux
2014/0034325 A1 2/2014 Jancha et al.
2017/0335658 A1 * 11/2017 Williamson ..... E21B 34/00
2021/0108487 A1 4/2021 Vick, Jr. et al.
2022/0349279 A1 11/2022 Dusterhoft et al.

FOREIGN PATENT DOCUMENTS

WO 2017093745 6/2017

OTHER PUBLICATIONS

International Search Report and Written Opinion for International Patent Application No. PCT/US2023/020915 dated Nov. 28, 2023. Netherlands Search Report and Written Opinion for NL Patent Application No. 2036954 dated Apr. 30, 2024. English Machine Translation with Original Untranslated Version, PDF file. 20 pages.

* cited by examiner

*Primary Examiner* — D. Andrews
(74) *Attorney, Agent, or Firm* — Scott Richardson; C. Tumey Law Group PLLC

(57) ABSTRACT

A subsurface safety valve system may include a tubular valve housing disposable within a wellbore, a primary flow tube moveably secured within the valve housing between an upper position and a lower position, and a secondary valve securable within the valve housing downhole from the primary flow tube and a primary valve. The secondary valve is actuatable between an open position and a closed position. Further, the subsurface safety valve system may include a tubular opening prong securable to the primary flow tube, wherein the opening prong is moveable axially downhole to drive the secondary valve into the open position in response to the primary flow tube moving to the lower position, and wherein the tubular opening prong is movable axially uphole to release the secondary valve to move into the closed position.

19 Claims, 10 Drawing Sheets

WIRELINE RETRIEVABLE OPENING PRONG

BACKGROUND

After drilling a wellbore in a subterranean formation for recovering hydrocarbons such as oil and gas lying beneath the surface, subsurface safety valves may be placed in the wellbore during completion operations. Subsurface safety valves are generally used as failsafe mechanisms to prevent the uncontrolled release of subsurface production fluids, should a wellbore system experience a loss in containment. Typically, subsurface safety valves are run-in-hole as part of a tubing string. Although several design variations are possible for subsurface safety valves, generally subsurface safety valves comprise flapper-type valves. Unfortunately, flapper-type valves may malfunction and prevent the valve from opening and closing to permit or restrain flow through the valve, respectively, as needed. Further, replacing the subsurface safety valves is costly and time consuming as the valve is generally pulled out-of-hole for repairs.

BRIEF DESCRIPTION OF THE DRAWINGS

These drawings illustrate certain aspects of the present disclosure and should not be used to limit or define the method.

DETAILED DESCRIPTION

Disclosed herein are systems and methods for installing, operating, and retrieving a secondary subsurface safety valve. More particularly, example embodiments may include a subsurface safety valve system that includes a primary valve and a secondary valve configured to locate and secure within a valve housing of the subsurface safety valve to restore functionality to the subsurface safety valve in response to malfunctioning or failure of the primary valve. The subsurface safety valve system may include a tubular opening prong for opening and closing the secondary valve. The tubular opening prong may also be secured within the valve housing during operation. However, in the event of failure or malfunction of the secondary valve, both the tubular opening prong and the secondary valve may be retrieved and replaced via a wireline retrieval tool. As such, the secondary valve may be replaced without pulling the subsurface safety valve system out-of-hole, which may reduce costs and downtime in the event of failure or malfunction.

Figure 1:
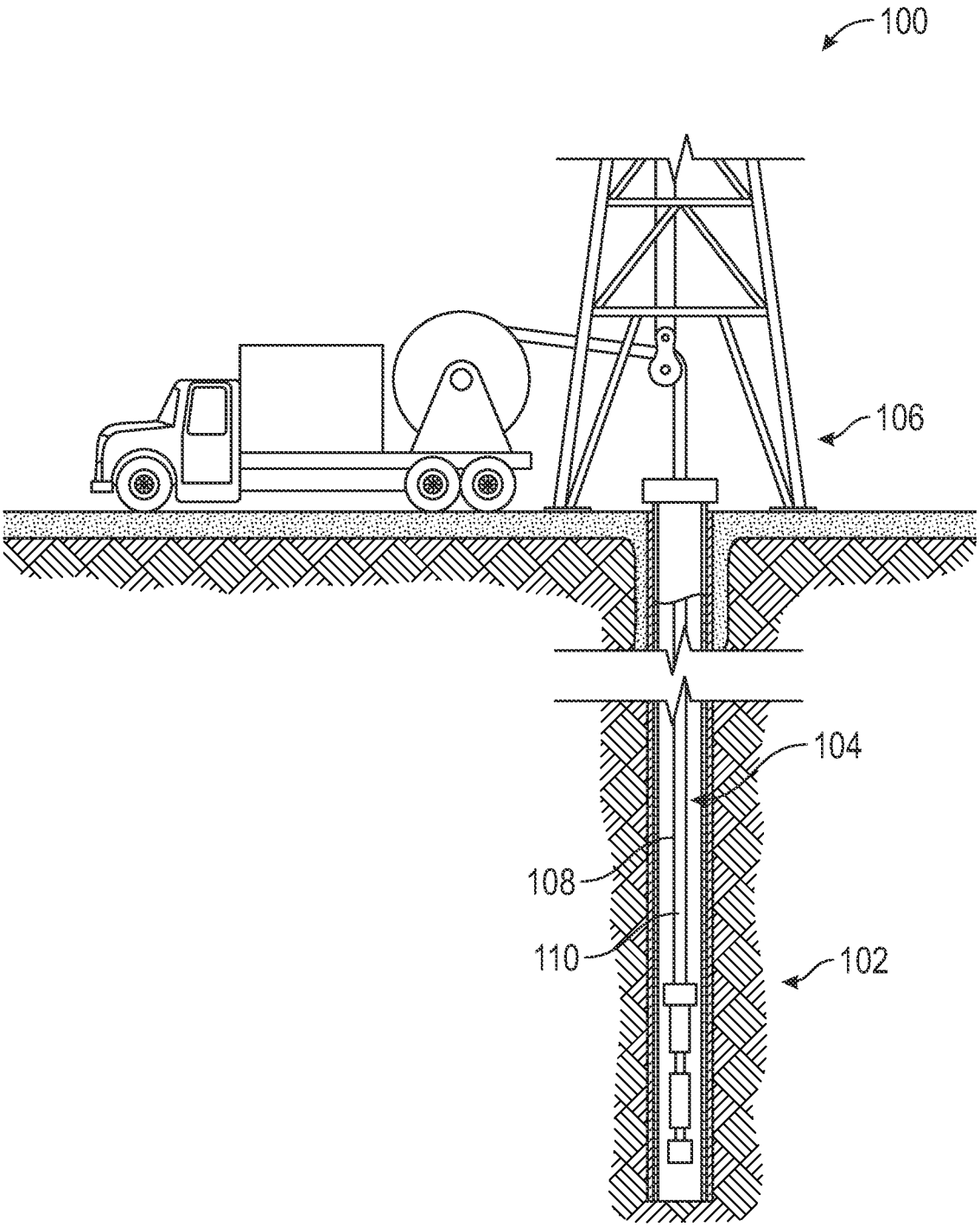
FIG. 1 is an elevation view of an example of a well system, in which aspects of the present disclosure may be implemented.

FIG. 1 is an elevation view of a well system, in which aspects of the present disclosure may be implemented. While FIG. 1 generally depicts land-based operations, the principles described herein are equally applicable to subsea operations that employ floating or sea-based platforms and rigs, without departing from the scope of the disclosure. As illustrated, the well system 100 includes a subsurface safety valve system 102 disposed within a wellbore 104 to prevent the uncontrolled release of subsurface production fluids, should the well system 100 experience a loss in containment. Generally, the subsurface safety valve system 102 (e.g., tubing retrievable subsurface safety valve) may be run-in-hole to a desired depth as part of a completion string. Alternatively, the subsurface safety valve system 102 (e.g., wireline retrievable subsurface safety valve) may be lowered to a desired position in the wellbore 104 via wireline.

Moreover, the subsurface safety valve system 102 may be in communication with the surface 106 via a control line 108 (e.g., hydraulic control line, electrical control line, etc.). The control line 108 may provide actuation power to the subsurface safety valve system 102. As set forth in greater detail below, the actuation power may be provided to the subsurface safety valve system 102, via the control line 108, to actuate the subsurface safety valve system 102. For example, a hydraulic control line may increase a pressure in the control line to ultimately open at least one valve of the subsurface safety valve system 102 to provide a flow path for subsurface production fluids to enter a conduit 110 (e.g., completion tubing, casing, casing liner, etc.). Reducing pressure in the hydraulic control line may ultimately close the at least one valve of the subsurface safety valve system 102 to block the flow path into the conduit 110.

As set forth above, a primary valve 200 (shown in FIG. 2) of the subsurface safety valve system 102 may fail or malfunction during well operations. In response to failure of the primary valve 200, a secondary valve (shown in FIG. 2) may be run-in-hole and secured within the subsurface safety valve system 102. The secondary valve 202 may be lowered into the wellbore 104 via wireline. However, the secondary valve 202 may be lowered into the wellbore 104 via any suitable tool. Further, a tubular opening prong 400 (shown in FIG. 4) for opening and closing the secondary valve 202 may be run-in-hole after the secondary valve 202 is located and secured within the subsurface safety valve system 102. The tubular opening prong 400 may be run-in-hole via any suitable tool. The tubular opening prong 400 may be considered tubular in that, for example, it may have an outer wall with a generally round cross-section across a portion of its length to conform with an internal diameter (ID) of a structure that it rides in and that it may have an interior that allows for passage of fluid other material therethrough.

Figure 2:
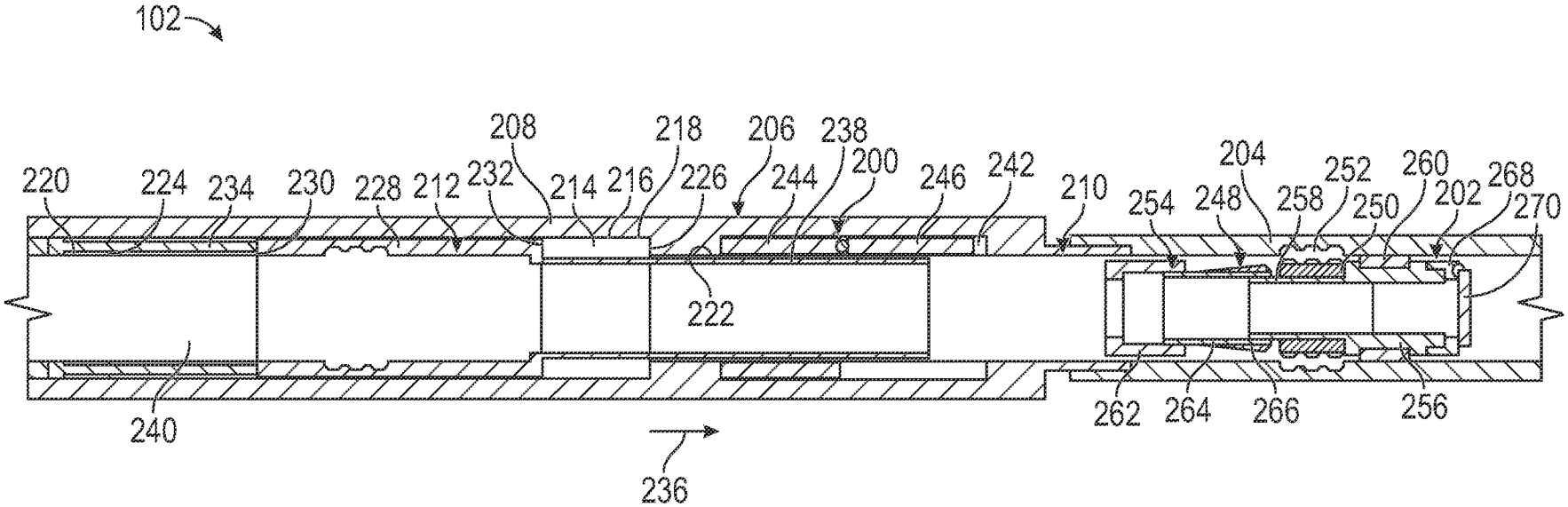
FIG. 2 is a cross-sectional view of a subsurface safety valve system according to an example configuration having a primary valve and a secondary valve run-in-hole and located at an end sub of the subsurface safety valve system.

FIG. 2 is a cross-sectional view of the subsurface safety valve system 102 according to an example configuration having a primary valve 200 and a secondary valve 202. For discussion purposes, the subsurface safety valve system 102 is shown run-in-hole and located at an end sub 204 of the subsurface safety valve system 102. The subsurface safety valve system 102 includes a tubular valve housing 206 disposable within the wellbore 104. That is, the tubular valve housing 206 may be run-in-hole as part of a completion tubing or lowered into the wellbore 104 via wireline. Moreover, the tubular valve housing 206 may include a main body portion 208. As illustrated, the tubular valve housing 206 may also include the end sub 204 secured to a downhole end 210 of the main body portion 208. The end sub 204 may be secured to the main body portion 208 via threaded connection or any other suitable connection.

The subsurface safety valve system 102 also includes a primary flow tube 212, which may be positioned within the main body portion 208. In particular, the primary flow tube 212 may be positioned within a flow tube recess 214 formed in an inner surface 216 of the main body portion 208 of the tubular valve housing 206. As illustrated, the flow tube recess 214, which receives the primary flow tube 212, may be formed along a first portion 218 of the inner surface 216 between adjacent portions (e.g., a second portion 220 and a third portion 222) of the inner surface 216. The inner surface 216 of the main body portion 208 comprises a variable diameter. In particular, the first portion 218 may have a larger diameter than the adjacent portions (e.g., the second portion 220 and the third portion 222), such that an upper shoulder 224 is formed at a transition from the second portion 220 to the first portion 218, and a lower shoulder 226 is formed at a transition from the first portion 218 to the third portion 222 of the inner surface 216. The flow tube recess 214 may be formed between the upper shoulder 224 and the lower shoulder 226 along the first portion 218 of the inner surface 216. However, the flow tube recess 214 may be formed in any suitable portion of the main body portion 208 for receiving the primary flow tube 212.

Further, the flow tube recess 214 may comprise a longer axial length than the primary flow tube 212 such that the primary flow tube 212 is axially moveable within the tubular valve housing 206 between an upper position and a lower position. In the illustrated embodiment, the primary flow tube is disposed between the upper position and the lower position. Moreover, in the illustrated embodiment, the primary flow tube is disposed between the upper position and the lower position. As illustrated, a diameter of a key body portion 228 of the primary flow tube 212 may include a diameter less than the first portion 218 of the inner surface 216, but greater than the second portion 220 and third portion 222 of the inner surface 216. As such, the upper shoulder 224 may contact an upper end 230 of the key body portion 228 to restrain uphole movement of the primary flow tube 212 at the upper position of the primary flow tube 212. Further, the lower shoulder 226 may contact a lower end 232 of the key body portion 228 to restrain downhole movement of the primary flow tube 212 at the lower position of the primary flow tube 212. As such, the primary flow tube 212 may be secured between the upper shoulder 224 and the lower shoulder 226 of the main body portion 208.

Further the primary flow tube 212 may be moveable (e.g., slidable) between the upper shoulder 224 and the lower shoulder 226 in response to actuation power from the control line 108. As illustrated, the tubular valve housing 206 may further include a piston 234 disposed adjacent the primary flow tube 212. The piston 234 may be configured to extend at least partially through the upper shoulder 224 to contact the upper end 230 of the key body portion 228 for driving movement of the primary flow tube 212. The piston 234 may move in response to actuation power in the control line 108 to drive movement of the primary flow tube 212. For example, the control line (e.g., hydraulic control line) may increase pressure, which may drive the piston 234 in the downhole direction 236. As the piston 234 moves in the downhole direction, contact between the piston 234 and the upper end 230 of the key body portion 228 may drive the primary flow tube 212 in the downhole direction 236.

As illustrated, the primary flow tube 212 may include a lower tube portion 238 having a smaller outer diameter than the key body portion 228. Additionally, the lower tube portion 238 may comprise a smaller diameter than the third portion 222 of the inner surface 216 such that the lower tube portion 238 may move along a central bore 240 of the tubular valve housing 206. In the illustrated embodiment, the lower tube portion 238 extends downhole from the key body portion 228. Moreover, as set forth in greater detail below, the lower tube portion 238 may interface with the primary valve 200 to hold the primary valve 200 in an open position. The primary valve 200 is secured within the main body portion 208 of the tubular valve housing 206. Specifically, the primary valve may be disposed within a valve recess 242 formed in the inner surface 216 of the main body portion 208 of the tubular valve housing 206, which may be formed downhole from the flow tube recess 214.

The primary valve 200 may include a primary valve seat 244 secured within the main body portion 208 of the tubular valve housing 206. Specifically, the primary valve seat 244 may be disposed within the valve recess 242. Moreover, the primary valve 200 may further include a primary flapper 246 secured to the primary valve seat 244. The primary flapper 246 is movable between the open position shown here in FIG. 2 and a closed position (e.g., with the primary flapper 246 rotated to engage the primary valve seat 244 and restrain fluid flow through the subsurface safety valve system 102). Indeed, the lower tube portion 238 of the primary flow tube 212 may contact the primary flapper 246 to drive the primary flapper 246 into the open position, as well as move uphole to release the primary flapper 246 to move into the closed position. However, as set forth above, the primary flapper 246 may fail and/or malfunction during completion operations. To restore functionality to the subsurface safety valve system 102 in response to malfunctioning or failure of the primary valve 200, a secondary valve 202 may be run-in-hole and secured within the tubular valve housing 206 of the subsurface safety valve system 102. During installation and operation of the secondary valve 202, the primary flow tube 212 and/or the tubular opening prong 400 may hold the primary valve 200 in the open position. Accordingly, a permanent lockout tool may not be needed to permanently open the primary valve 200.

The secondary valve 202 is securable within the tubular valve housing 206 downhole from the primary flow tube 212 and the primary valve 200. For example, as illustrated, the secondary valve 202 may engage the end sub 204 of the tubular valve housing 206. The secondary valve 202 may include a lower key assembly 248 having at least one lower key 250. As set forth in greater detail below, the at least one lower key 250 is expandable into a corresponding lower key slot 252 formed in the tubular valve housing 206 to secure the secondary valve 202 to the tubular valve housing 206. As illustrated, the lower key slot 252 may be formed in the end sub 204. Further, the lower key 250 is retractable from the lower key slot 252 to release the secondary valve 202 from the tubular valve housing 206.

Additionally, the lower key assembly 248 may include a shifting portion 254 and a seal portion 256. The seal portion 256 may include a mandrel 258 and a seal 260 secured to an outer surface of the mandrel 258. As illustrated, the seal 260 may interface with the tubular valve housing 206 (e.g., an inner surface of the end sub 204) to restrain fluid flow between the secondary valve 202 and the inner surface of the tubular valve housing 206. Moreover, the shifting portion 254 may move axially with respect to the seal portion 256 between an extended position and a mated position. As illustrated, the shifting portion 254 may include a lower anchor portion 262 and a lower support portion 264 rigidly connected to a downhole end of the lower anchor portion 262. The lower support portion 264 may interface and slide along the mandrel 258 of the seal portion 256. In the illustrated embodiment, the shifting portion 254 is in the extended position such that the lower support portion 264 is disposed uphole from the at least one lower key 250, but still connected to the mandrel 258. The lower key assembly 248 may include a stop for restraining movement of the shifting portion 254 away from the seal portion 256 at the extended position to maintain connection between the shifting portion 254 of and the seal portion 256.

The shifting portion 254 may include a lower shim 266 extending from a downhole end of the shifting portion 254. In particular, the lower shim 266 may extend from the downhole end of the lower anchor portion 262. Further, the lower shim 266 may be secured to the lower support portion 264. As illustrated, the lower shim 266 may be secured to a radially outer surface of the lower support portion 264. Alternatively, the lower support portion 264 may comprise the lower shim 266. As the shifting portion 254 moves from the extended position to the mated position, the lower shim 266 may be driven into contact with the at least one lower key 250. As set forth in greater detail below, such contact may bias the at least one lower key 250 in a radially outward direction into the corresponding lower key slot 252 formed in the tubular valve housing 206.

Moreover, the secondary valve 202 may further include a secondary valve seat 268 connected to a downhole end of the lower key assembly 248. In particular, the secondary valve seat 268 may be connected to a downhole end of the seal portion 256. Additionally, the secondary valve 202 may include a secondary flapper 270 secured to the secondary valve seat 268. As set forth in greater detail below, the secondary flapper 270 is actuatable between an open position and a closed position.

Figure 3:
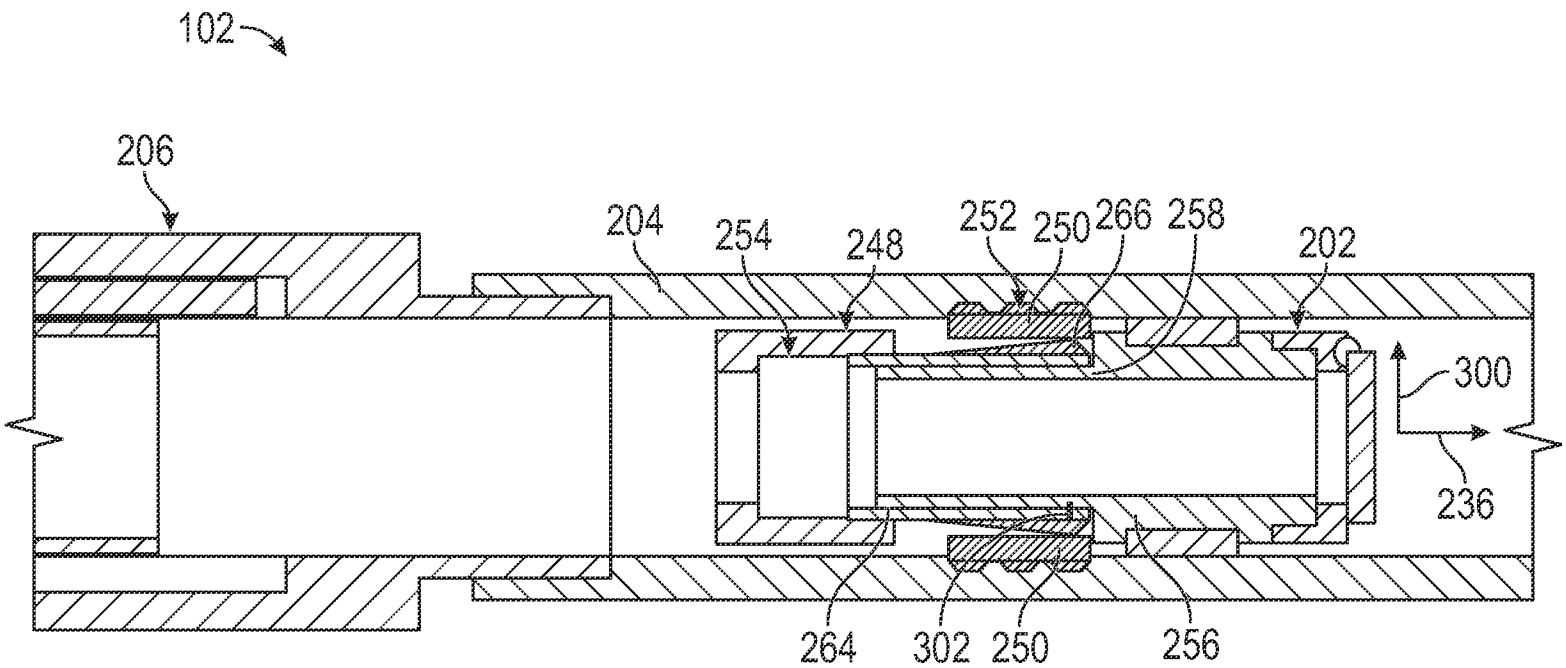
FIG. 3 is a cross-sectional view of the secondary safety valve locked to the end sub.

FIG. 3 is a cross-sectional view of the secondary valve 202 (e.g., secondary subsurface safety valve) locked to the end sub 204. As set forth above, the secondary valve 202 is run-in-hole and located within the subsurface safety valve system 102. In particular, the secondary valve 202 is located such that the at least one lower key 250 of the lower key assembly 248 is axially aligned with the lower key slot 252 formed in the tubular valve housing 206 (e.g., the end sub 204 of the tubular valve housing 206). Once in position, the shifting portion 254 may be moved from the extended position to the mated position. As the shifting portion 254 moves from the extended position to the mated position, the lower shim 266 may be driven into contact with the at least one lower key 250. Specifically, a lower end of the lower shim 266 may be wedged between the mandrel 258 of the seal portion 256 and the at least one lower key 250. As the lower shim 266 continues to be driven in the downhole direction 236 between the mandrel 258 and the at least one lower key 250, the at least one lower key 250 may be biased in a radially outward direction 300 into the axially aligned lower key slot 252 formed in the tubular valve housing 206. Further, maintaining the lower shim 266 in position between the at least one lower key 250 and the mandrel 258 may hold the at least one lower key 250 in an expanded position with the at least one lower key 250 secured in the corresponding lower key slot 252.

Moreover, the secondary valve 202 may further include a lower lock feature 302 to hold the at least one lower key 250 in the expanded position with the at least one lower key 250 secured in the corresponding lower key slot 252. In particular, the lower lock feature 302 may hold the lower shim 266 in the position between the at least one lower key 250 and the mandrel 258. The lower lock feature 302 may include a shear pin, a shear screw, and/or any suitable fastener for holding the lower shim 266 in position. The lower lock feature 302 may be disposed in the mandrel 258 and engage the lower shim 266 in response to the lower shim 266 moving into the position between the at least one lower key 250 and the mandrel 258. Alternatively, the lower lock feature 302 may be disposed in the lower shim 266 and/or the lower support portion 264 and engage the mandrel 258 in response to the lower shim 266 moving into the position between the at least one lower key 250 and the mandrel 258. The lower lock feature 302 may include a spring (not shown) or any suitable feature for driving the lower lock feature 302 to engage the mandrel 258, the lower shim 266, and/or the lower support portion 264.

Figure 4:
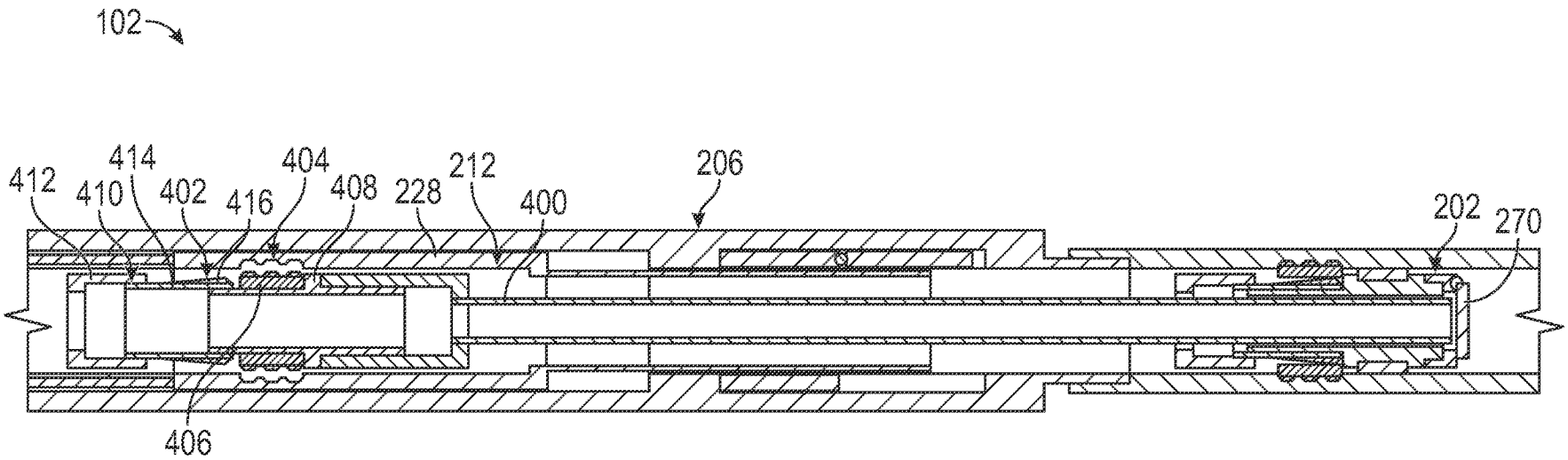
FIG. 4 is a cross-sectional view a tubular opening prong and upper key assembly run-in-hole and located in a valve housing of the subsurface safety valve, in accordance with a further example configuration.

FIG. 4 is a cross-sectional view a tubular opening prong 400 and an upper key assembly 402 run-in-hole and located in a tubular valve housing 206 of the subsurface safety valve system 102, in accordance with a further example configuration. With the secondary valve 202 secured within the subsurface safety valve system 102, the tubular opening prong 400 may be run-in-hole to the tubular valve housing 206 of the subsurface safety valve system 102. Generally, the tubular opening prong 400 may interface with the secondary flapper 270 of the secondary valve 202 to open and close the secondary valve 202 during well operations. As set forth in greater detail below, the tubular opening prong 400 may be secured to the primary flow tube 212, and movement of the primary flow tube 212 may drive the tubular opening prong 400 to contact and drive open the secondary flapper 270. As such, direct fluid communication, via a fluid communication tool, to the secondary valve 202 may not be necessary to actuate (e.g., to open and close) the secondary valve.

As illustrated, the primary flow tube 212 may have an upper key slot 404 formed in a radially inner surface of the primary flow tube 212. Specifically, the upper key slot 404 may be formed in a radially inner surface of the key body portion 228 of the primary flow tube 212. However, the upper key slot 404 may be formed in any suitable portion of the primary flow tube 212. Further, the subsurface safety valve system 102 may include an upper key assembly 402 having at least one upper key 406, which is expandable and retractable with respect to a lower body portion 408 of the upper key assembly 402. As illustrated, the upper key assembly 402 may be lowered into the subsurface safety valve system 102 to a position with the upper key 406 axially aligned with the upper key slot 404, such that expansion of the upper key 406 may secure the upper key assembly 402 within the upper key slot 404.

Additionally, the tubular opening prong 400 may be secured to the primary flow tube 212 via the upper key assembly 402. The tubular opening prong 400 may be secured to the upper key assembly 402 via a threaded connection and/or any suitable fastener. Further, the tubular opening prong 400 may be secured to a downhole end of the upper key assembly 402. Alternatively, the tubular opening prong 400 may be secured to the primary flow tube 212 directly or via any suitable fastener such that movement of the primary flow tube 212 may drive the tubular opening prong 400 to move to contact and drive open the secondary flapper 270 of the secondary valve.

Moreover, the upper key assembly may have an upper body portion 410 and the lower body portion 408. The upper body portion 410 may include an upper anchor portion 412 and an upper support portion 414 rigidly connected to a downhole end of the upper anchor portion 412. The upper body portion 410 may move axially with respect to the lower body portion 408 between an extended position and a collapsed position. Specifically, the upper support portion 414 may move with respect to the lower body portion 408 of the upper key assembly 402 between an extended position and a collapsed position. In the illustrated embodiment, the upper body portion 410 is disposed in the extended position such that the upper support portion 414 is disposed uphole from the at least one upper key 406 but is still connected to the lower body portion 408. The upper key assembly 402 may include a stop for restraining movement of the upper body portion 410 away from the lower body portion 408 at the extended position to maintain connection between the upper body portion 410 of and the lower body portion 408.

The upper body portion 410 may further include an upper shim 416 extending from a downhole end of the upper body portion 410. In particular, the upper shim 416 may extend from the downhole end of the upper anchor portion 412. Further, the upper shim 416 may be secured to the upper support portion 414. As illustrated, the upper shim 416 may be secured to a radially outer surface of the upper support portion 414. Alternatively, the upper support portion 414 may comprise the upper shim 416. As the upper body portion 410 moves from the extended position to the mated position (shown in FIG. 5), the upper shim 416 may be driven into contact with the at least one upper key 406. As set forth in greater detail below, such contact may bias the at least one upper key 406 in a radially outward direction into the corresponding upper key slot 404 formed in the primary flow tube 212.

Figure 5:
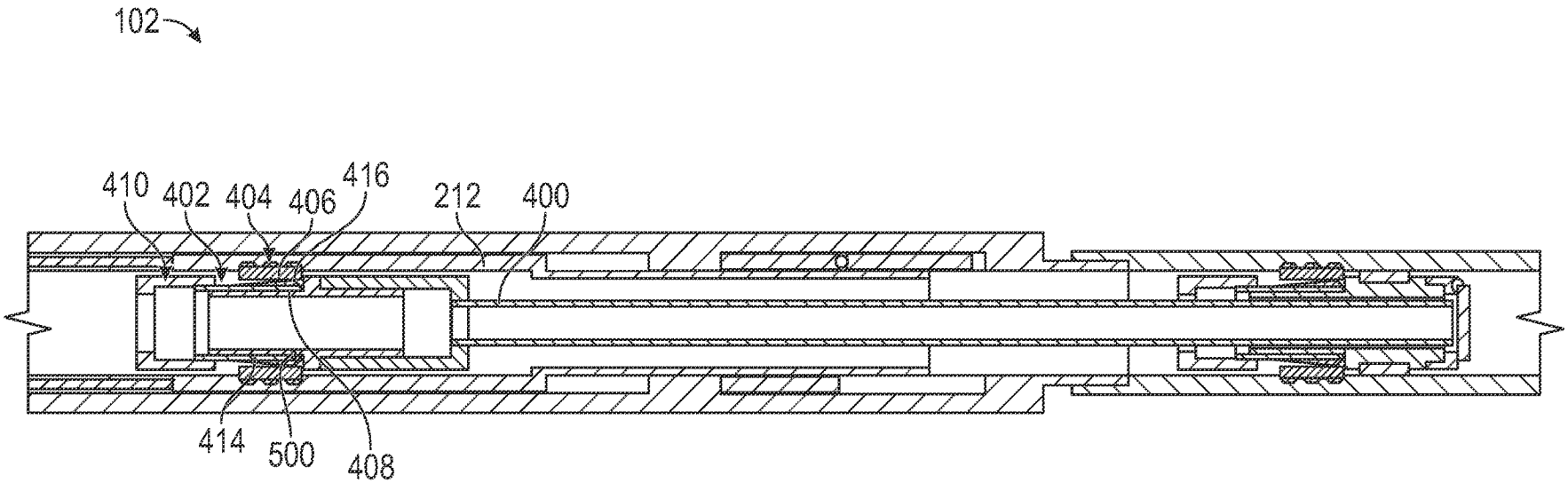
FIG. 5 is a cross-sectional view of the upper key assembly locked to a primary flow tube of the subsurface safety valve.

FIG. 5 is a cross-sectional view of the upper key assembly 402 locked to a primary flow tube 212 of the subsurface safety valve system 102. As set forth above, the tubular opening prong 400 is secured to the upper key assembly 402 and the upper key assembly 402 is lowered into the subsurface safety valve system 102 to a position with the upper key 406 axially aligned with the upper key slot 404 formed in the primary flow tube 212. Once in position, the upper body portion 410 may be moved from the extended position to the collapsed position. As the upper body portion 410 moves from the extended position to the collapsed position, the upper shim 416 may be driven into contact with the at least one upper key 406. Specifically, a lower end of the upper shim 416 may be wedged between the lower body portion 408 and the at least one upper key 406. As the upper shim 416 continues to be driven in the downhole direction 236 between the lower body portion 408 and the at least one upper key 406, the at least one upper key 406 may be biased in the radially outward direction into the axially aligned upper key slot 404 formed in the primary flow tube 212. Further, maintaining the upper shim 416 in position between the at least one upper key 406 and the lower body portion 408 may hold the at least one upper key 406 in the expanded position with the at least one upper key 406 secured in the corresponding upper key slot 404.

Moreover, the upper key assembly 402 may further include an upper lock feature 500 to hold the at least one upper key 406 in the expanded position with the at least one upper key 406 secured in the corresponding upper key slot 404. In particular, the upper lock feature 500 may hold the upper shim 416 in the position between the at least one upper key 406 and the lower body portion 408. The upper lock feature 500 may include a pin, a shear screw, and/or any suitable fastener for holding the upper shim 416 in position. The upper lock feature 500 may be disposed in the lower body portion 408 and engage the upper shim 416 in response to the upper shim 416 moving into the position between the at least one upper key 406 and the lower body portion 408. Alternatively, the upper lock feature 500 may be disposed in the upper shim 416 and/or the upper support portion 414 and engage the lower body portion 408 in response to the upper shim 416 moving into the position between the at least one upper key 406 and the lower body portion 408. The upper lock feature 500 may include a spring (not shown) or any suitable feature for driving the upper lock feature 500 to engage the lower body portion 408, the upper shim 416, and/or the upper support portion 414.

Figure 6:
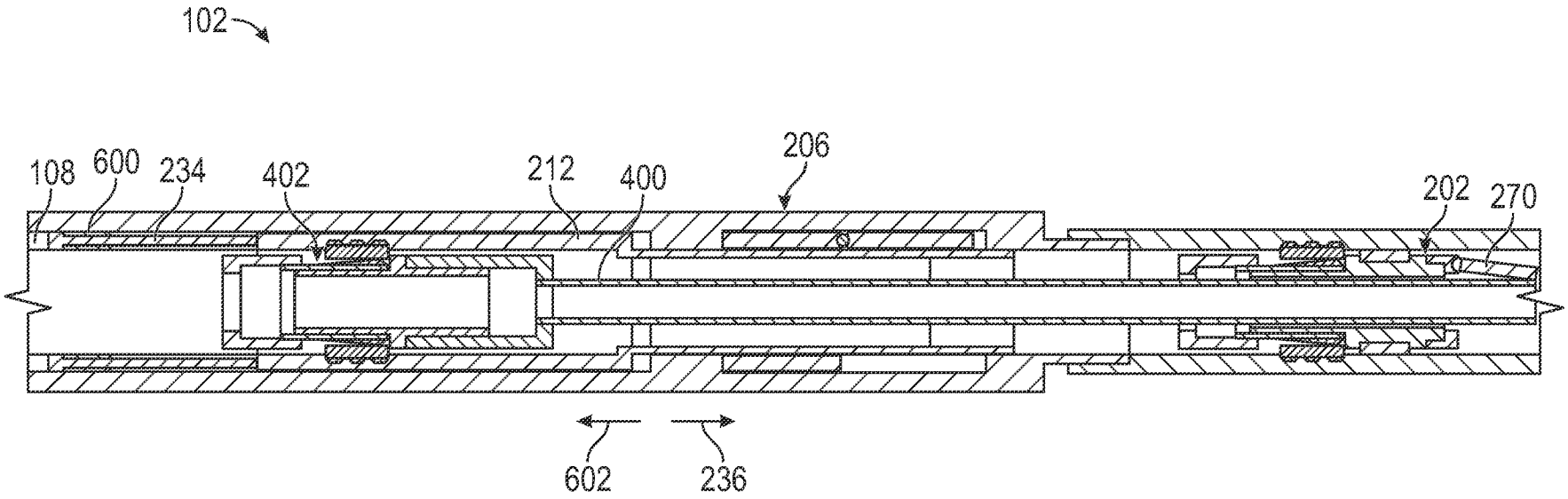
FIG. 6 is a cross-sectional view of the primary flow tube driven from an upper position to a lower position to move the tubular opening prong into a position to open the secondary safety valve.

FIG. 6 is a cross-sectional view of the primary flow tube 212 driven from an upper position to a lower position to move the tubular opening prong 400 into a position to open the secondary valve 202. As set forth above, the subsurface safety valve system 102 may include a piston 234 disposed within the tubular valve housing 206. The piston 234 is moveable between a first and second position in response to actuation power (e.g., a threshold fluid pressure in the control line 108). Further, movement of the piston 234 from the first position to the second position may drive the primary flow tube 212 from the upper position to the lower position. That is, the piston 234 may interface with the primary flow tube 212 to drive the primary flow tube 212 in the downhole direction 236. Alternatively, the piston 234 may be magnetically connected to the primary flow tube 212 to drive movement of the primary flow tube 212. Further, additional or alternative features may be incorporated such that movement of the piston 234 may drive movement of the primary flow tube 212. Moreover, as set forth above, the tubular opening prong 400 is secured to the primary flow tube 212 via the upper key assembly 402. As such, moving the primary flow tube 212 to the lower position may drive the tubular opening prong 400 axially downhole into the secondary valve 202 and into the secondary flapper 270, which may drive the secondary flapper 270 into an open position.

During well operations, actuation power may be released (e.g., fluid pressure in the control line 108 may be lowered below the threshold pressure) to move the primary flow tube 212 to the upper position, which may release the secondary flapper 270 to move to the closed position. In particular, the subsurface safety valve system 102 may include a spring assembly 600 disposed in the tubular valve housing 206. The spring assembly 600 may bias the piston 234 with sufficient force to move the piston 234 from the second position toward the first position in response to the fluid pressure in the control line 108 being below the threshold pressure. As such, the primary flow tube 212 may be biased in the uphole direction 602 toward the upper position in the absence of sufficient pressure in the control line 108, which may close the secondary flapper 270 of the secondary valve 202. Alternatively, as set forth above, the secondary valve 202 may be closed in response to releasing the upper key assembly 402 and pulling the upper key assembly 402 and the tubular opening prong 400 in the uphole direction 602 with respect to the secondary valve 202.

Figure 7:
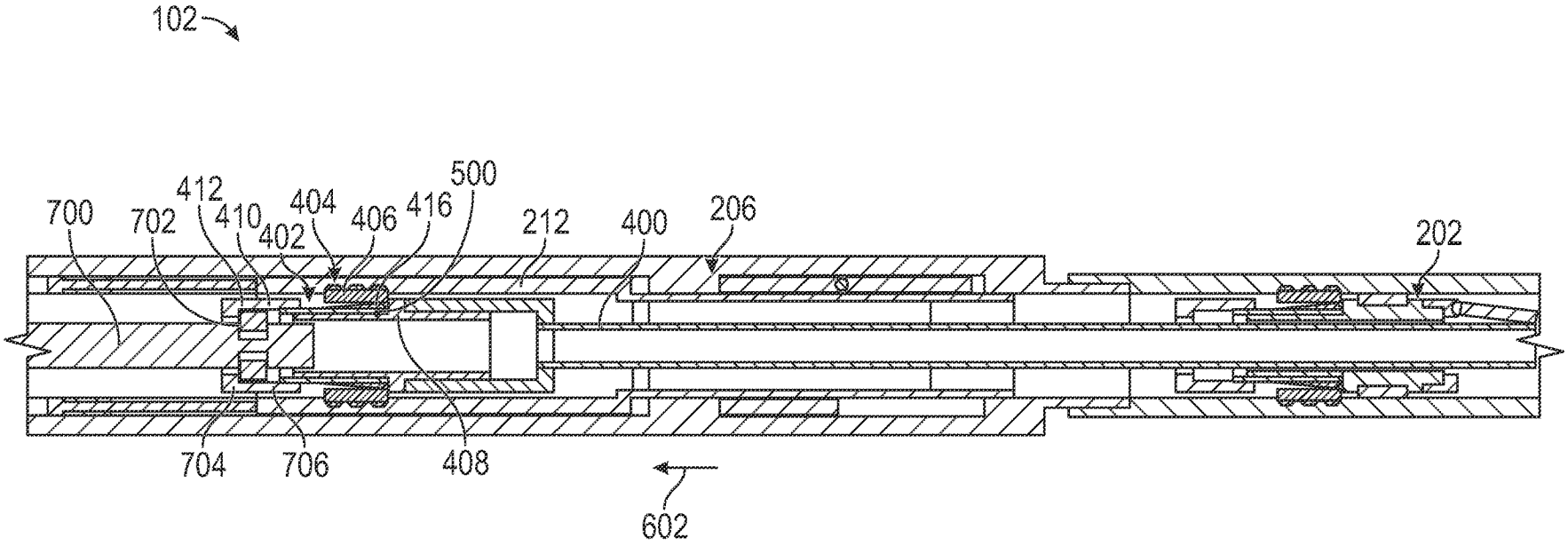
FIG. 7 is a cross-sectional view of a retrieval tool according to an example configuration, secured to the upper key assembly.

FIG. 7 is a cross-sectional view of a retrieval tool 700 according to an example configuration, secured to the upper key assembly 402. As set forth above, in the event of malfunction or failure of the secondary valve 202 of the subsurface safety valve system 102, the secondary valve 202, the tubular opening prong 400, and the upper key assembly 402, may be removed and replaced without pulling the tubular valve housing 206 of the subsurface safety valve system 102 out of hole. As illustrated, the upper body portion 410 of the upper key assembly 402 may comprise the upper anchor portion 412 having an upper lip 702 formed in a radially inner surface of the upper body portion 410. In particular, the upper lip 702 may be formed in the radially inner surface of the upper anchor portion 412 of the upper body portion 410. The upper lip 702 may be formed via a variable inner diameter of the radially inner surface of the upper anchor portion 412. That is, an upper end 704 of the radially inner surface of the upper anchor portion 412 may have a greater diameter than a lower end 706 of the radially inner surface of the upper anchor portion 412, which may form the upper lip 702 at the transition between the upper end 704 and the lower end 706 of the radially inner surface of the upper anchor portion 412. Moreover, the upper lip 702 may interface with a retrieval tool 700 (e.g., wireline retrieval tool).

As illustrated, the retrieval tool 700 may be lowered into the upper key assembly 402 and interface with the upper lip 702. The retrieval tool 700 may jar the upper key assembly 402 by driving the retrieval tool 700 in the uphole direction 602 while interfaced with the upper lip 702 such that driving force applied to the retrieval tool 700 is transferred to the upper key assembly 402 via the interface. Such force on the upper key assembly 402 may shear the upper lock feature 500 holding the upper shim 416 in position. With the upper lock feature 500 sheared, continual upward force on the upper lip 702 via the retrieval tool 700, may pull the upper body portion 410 of the upper key assembly 402 from the collapsed position to the extended position. As set forth above, moving the upper body portion 410 to the extended position may pull the upper shim 416 uphole from the upper key 406 such that the upper key 406 may radially retract toward the lower body portion 408 of the upper key assembly 402 from the upper key slot 404; thereby, releasing the upper key assembly 402 from the primary flow tube 212.

Figure 8:
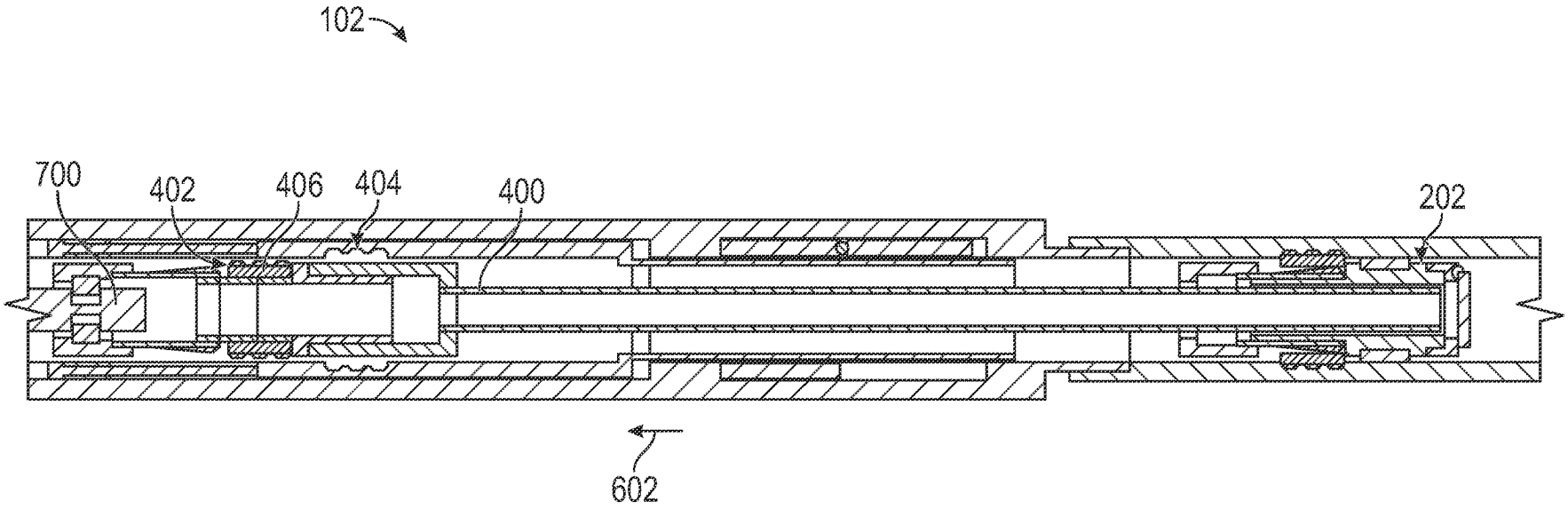
FIG. 8 is a cross-sectional view of the upper key assembly released and pulled in the uphole direction via the retrieval tool.

FIG. 8 is a cross-sectional view of the upper key assembly 402 released and pulled in the uphole direction 602 via the retrieval tool 700. As illustrated, the upper key assembly 402 of the subsurface safety valve system 102 is in the extended position and released from the upper key slot 404 formed in the primary flow tube 212. With the upper key assembly 402 released (e.g., with the upper key 406 retracted from the upper key slot 404), the retrieval tool 700 may pull the upper key assembly 402 and the tubular opening prong 400 out of hole. Moreover, as illustrated, moving the tubular opening prong 400 axially uphole (e.g., out of hole) may release the secondary valve 202 to move into the closed position as illustrated.

Figure 9:
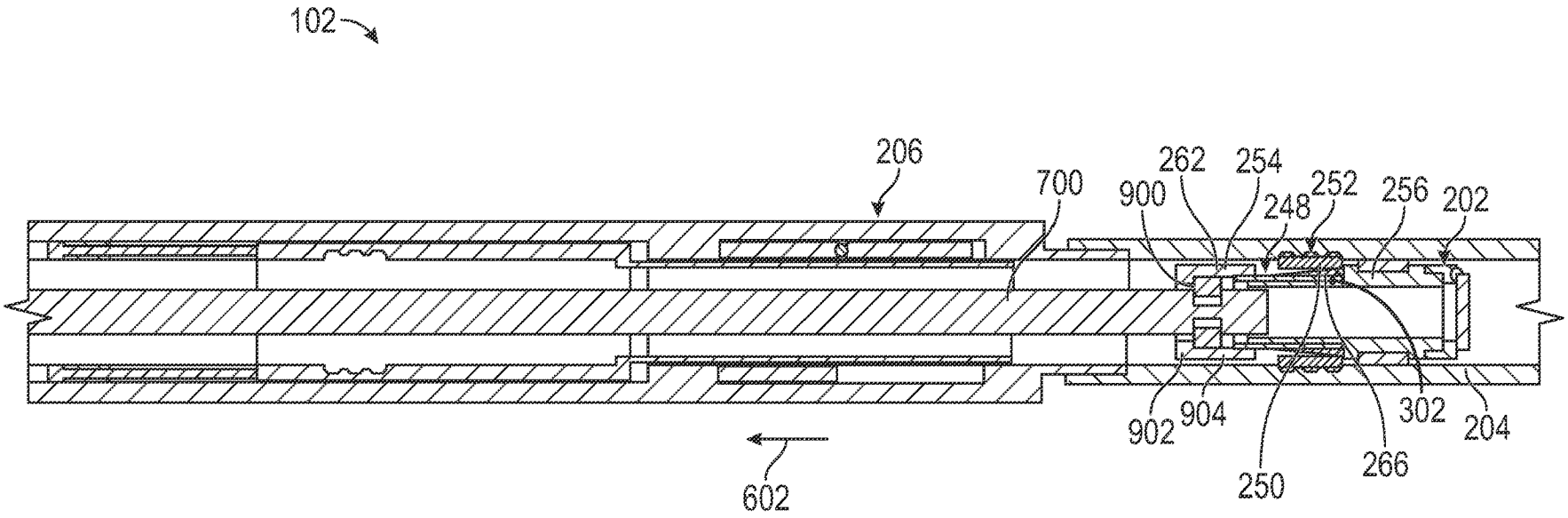
FIG. 9 is a cross-sectional view of the retrieval tool secured to the lower key assembly of the secondary safety valve.

FIG. 9 is a cross-sectional view of the retrieval tool 700 secured to the lower key assembly 248 of the secondary valve 202. As set forth above, in the event of malfunction or failure of the secondary valve 202, the secondary valve 202, the tubular opening prong (shown in FIG. 8), and the upper key assembly 402 (shown in FIG. 8), may be removed and replaced without pulling the tubular valve housing 206 of the subsurface safety valve system 102 out of hole. As illustrated, the tubular opening prong 400 and the upper key assembly 402 have been pulled out of hole and the retrieval tool 700 is lowered into the secondary valve 202 to retrieve the secondary valve 202.

As illustrated, the shifting portion 254 of the lower key assembly 248 may comprise the lower anchor portion 262 having an inner lip 900 formed in a radially inner surface of the shifting portion 254. In particular, the inner lip 900 may be formed in the radially inner surface of the lower anchor portion 262 of the shifting portion 254. The inner lip 900 may be formed via a variable inner diameter of the radially inner surface of the lower anchor portion 262. That is, an upper end 902 of the radially inner surface of the lower anchor portion 262 may have a greater diameter than a lower end 904 of the radially inner surface of the lower anchor portion 262, which may form the inner lip 900 at the transition between the upper end 902 and the lower end 904 of the radially inner surface of the lower anchor portion 262. Moreover, the inner lip 900 may interface with the retrieval tool 700 (e.g., wireline retrieval tool).

As illustrated, the retrieval tool 700 may be lowered into the lower key assembly 248 of the secondary valve 202 and interface with the inner lip 900. The retrieval tool 700 may jar the lower key assembly 248 by driving the retrieval tool 700 in the uphole direction 602 while interfaced with the inner lip 900 such that driving force applied to the retrieval tool 700 is transferred to the lower key assembly 248 via the interface. Such forces on the lower key assembly 248 may shear the lower lock feature 302 holding the lower shim 266 in position. With the lower lock feature 302 sheared, continual upward force on the inner lip 900 via the retrieval tool 700, may pull the shifting portion 254 of the lower key assembly 248 from the mated position to the extended position. As set forth above, moving the shifting portion 254 to the extended position may pull the lower shim 266 uphole from the lower key 250 such that the lower key 250 may radially retract toward the seal portion 256 of the lower key assembly 248 from the lower key slot 252; thereby, releasing the lower key assembly 248 and the secondary valve 202 from the tubular valve housing 206 (e.g., the end sub 204).

Figure 10:
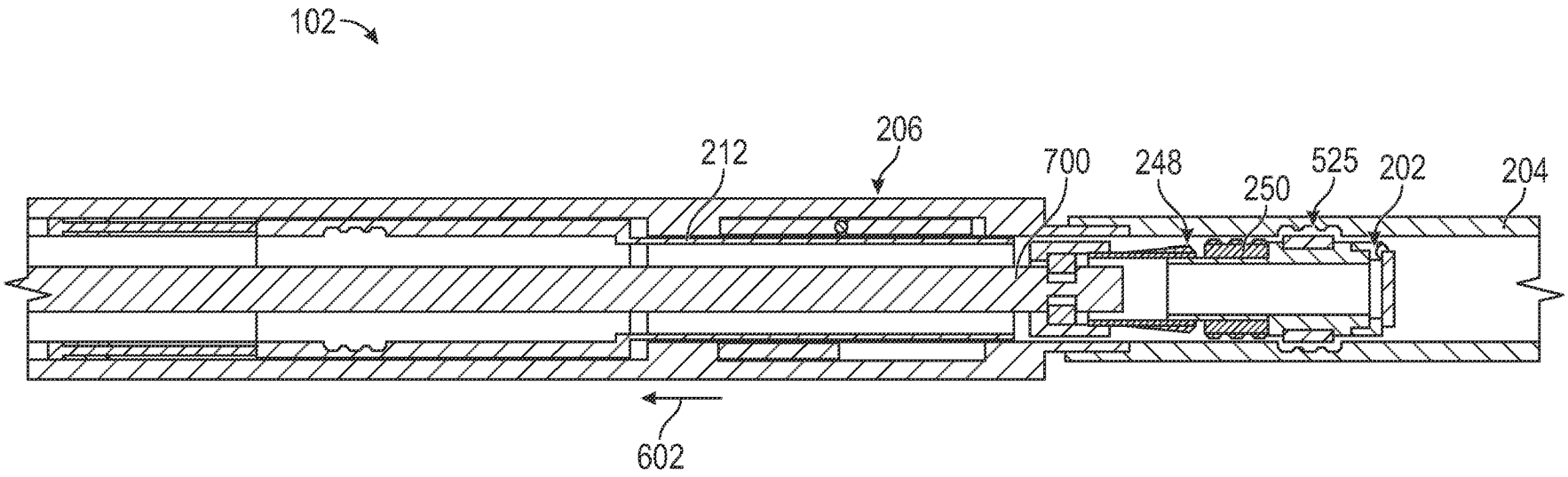
FIG. 10 is a cross-sectional view of the lower key assembly released and pulled in the uphole direction via the retrieval tool.

FIG. 10 is a cross-sectional view of the lower key assembly 248 released and pulled in the uphole direction 602 via the retrieval tool 700. As illustrated, the lower key assembly 248 is in the extended position and released from the lower key slot 252 formed in the tubular valve housing 206 (e.g., the end sub 204). The lower key assembly 248 and the secondary valve 202 may have a smaller outer diameter than the inner surface of the primary flow tube 212 and an inner surface of the tubular valve housing 206. Accordingly, with the lower key assembly 248 released (e.g., with the lower key 250 retracted from the lower key slot 252), the retrieval tool 700 may pull the lower key assembly 248 and the secondary valve 202 uphole through the subsurface safety valve system 102 and out of hole. Once removed, an alternative secondary valve may be lowered into the subsurface safety valve system 102 to replace the removed secondary valve 202.

Accordingly, the present disclosure may provide a subsurface safety valve system having a retrievable secondary valve, as well as an upper key assembly and tubular opening prong for operating the secondary valve. The systems and methods may include any of the various features disclosed herein, including one or more of the following statements.

Statement 1. A subsurface safety valve system, comprising: a tubular valve housing disposable within a wellbore; a primary flow tube moveably secured within the valve housing between an upper position and a lower position; a secondary valve securable within the valve housing downhole from the primary flow tube and a primary valve, wherein the secondary valve is actuatable between an open position and a closed position; and a tubular opening prong securable to the primary flow tube, wherein the tubular opening prong is moveable axially downhole to drive the secondary valve into the open position in response to the primary flow tube moving to the lower position, and wherein the tubular opening prong is movable axially uphole to release the secondary valve to move into the closed position.

Statement 2. The subsurface safety valve system of statement 1, wherein the tubular valve housing comprises a main body portion and an end sub secured to a downhole end of the main body portion, and wherein the secondary valve is engageable the end sub to secure the secondary valve to the end sub of the tubular valve housing.

Statement 3. The subsurface safety valve system of any preceding statement, wherein the primary valve is secured within the main body portion of the tubular valve housing.

Statement 4. The subsurface safety valve system of any preceding statement, wherein the primary valve comprises: a primary valve seat secured within a main body portion of the valve housing; and a primary flapper secured to the primary valve seat, wherein the tubular opening prong is configured to hold the primary flapper in an open position.

Statement 5. The subsurface safety valve system of any preceding statement, further comprising a fluid control line and piston disposed within the tubular valve housing, wherein the piston is moveable between a first and second position in response to fluid pressure in the fluid control line, and wherein movement of the piston from the first position to the second position drives the primary flow tube from the upper position to the lower position.

Statement 6. The subsurface safety valve system of any preceding statement, further comprising a spring assembly disposed in the valve housing, wherein the spring assembly is configured to bias the piston from the second position toward the first position.

Statement 7. The subsurface safety valve system of any preceding statement, further comprising an upper key assembly having at least one upper key, wherein the at least one upper key is expandable into a corresponding upper key slot formed in the primary flow tube to secure the upper key assembly to the primary flow tube, wherein the upper key is retractable from the upper key slot to release the upper key assembly from the primary flow tube, and wherein the tubular opening prong is secured to a lower end of the upper key assembly.

Statement 8. The subsurface safety valve system of any preceding statement, wherein the upper key assembly comprises an upper body portion and a lower body portion, wherein the upper body portion is axially moveable with respect to the lower body portion between an extended position and a collapsed position.

Statement 9. The subsurface safety valve system of any preceding statement, wherein the upper body portion comprises a shim extending from a downhole end of the upper body portion, wherein the shim contacts the at least one upper key in the collapsed position to bias the at least one upper key in a radially outward direction into the corresponding upper key slot formed in the primary flow tube.

Statement 10. The subsurface safety valve system of any preceding statement, further comprising an upper lock feature configured to engage and hold the shim in the collapsed position, wherein the upper lock feature comprises a shear pin, a shear screw, or some combination thereof.

Statement 11. The subsurface safety valve system of any preceding statement, wherein the upper body portion comprises a hollow mandrel having an upper lip formed in a radially inner surface of the upper body portion, wherein the upper lip is configured to interface with a retrieval tool, and wherein the retrieval tool is configured to jar the upper body portion, via the upper lip, to shear an upper lock feature holding the upper body portion in the collapsed position.

Statement 12. The subsurface safety valve system of any preceding statement, wherein the secondary valve comprises: a lower key assembly having at least one lower key, wherein the at least one lower key is expandable into a corresponding lower key slot formed in the valve housing to secure the secondary valve to the valve housing, and wherein the lower key is retractable from the lower key slot to release the secondary valve from the valve housing; a secondary valve seat connected to a downhole end of the lower key assembly; and a secondary flapper secured to the secondary valve seat, wherein the secondary flapper is actuatable between an open position and a closed position.

Statement 13. The subsurface safety valve system of any preceding statement, wherein the lower key assembly comprises a shifting portion and a seal portion, wherein the seal portion comprises a mandrel and a seal secured to an outer surface of the mandrel, wherein the seal is configured to interface with the valve housing, and wherein the shifting portion is moveable axially with respect to the seal portion between an extended position and a mated position.

Statement 14. The subsurface safety valve system of any preceding statement, wherein the shifting portion comprises a shim extending from a downhole end of the shifting portion, wherein the shim is configured to contact the at least one lower key in the mated position to bias the at least one lower key in a radially outward direction into the corresponding lower key slot formed in the valve housing.

Statement 15. The subsurface safety valve system of any preceding statement, wherein the shifting portion comprises a hollow mandrel having an inner lip formed at an uphole end of the shifting portion, wherein the inner lip is configured to interface with a retrieval tool with the tubular opening prong removed from the wellbore, and wherein the retrieval tool is configured to jar the shifting portion, via the inner lip, to shear a lower lock feature holding the shifting portion in the mated position.

Statement 16. A subsurface safety valve system, comprising: a tubular valve housing disposable within a wellbore, the valve housing having a lower key slot; a primary flow tube axially moveable within the valve housing between an upper position and a lower position, the primary flow tube having an upper key slot formed in a radially inner surface of the primary flow tube; a secondary valve securable within the valve housing downhole from the primary flow tube and a primary valve, wherein the secondary valve comprises a lower key assembly having a lower key configured to expand into the corresponding lower key slot formed in the valve housing to secure the secondary valve to the valve housing; a secondary valve seat connected to a downhole end of the lower key assembly; a secondary flapper secured to the secondary valve seat, wherein the secondary flapper is actuatable between an open position and a closed position; an upper key assembly comprising an upper key, wherein the upper key is expandable into the upper key slot to secure the upper key assembly to the primary flow tube; and a tubular opening prong secured to a downhole end of the upper key assembly, wherein the opening prong is moveable axially downhole to drive the secondary flapper into the open position in response to the primary flow tube moving to the lower position, and wherein the opening prong is moveable axially uphole to release the secondary flapper to move into the closed position.

Statement 17. The subsurface safety valve system of statement 16, wherein the upper key assembly comprises an upper lock feature configured to hold the upper key in the corresponding upper key slot, and wherein a retrieval tool is configured to jar the upper key assembly to shear the upper lock feature and release the upper key to retract from the upper key slot, and wherein retracting the upper key is configured to release the upper key assembly and the tubular opening prong from the primary flow tube for removal from the wellbore.

Statement 18. The subsurface safety valve system of statement 16 or statement 17, wherein the upper key assembly comprises an upper lip formed in a radially inner surface of the upper key assembly, wherein the upper lip is configured to interface with the retrieval tool.

Statement 19. The subsurface safety valve system of any of statements 16-18, wherein the secondary valve comprises a lower lock feature configured to hold the lower key in the corresponding lower key slot, and wherein a retrieval tool is configured to jar the secondary valve to shear the lower lock feature and release the lower key to retract from the lower key slot, and wherein retracting the lower key is configured to release the secondary valve from the valve housing.

Statement 20. A method for actuating a secondary subsurface safety valve, comprising: applying a threshold pressure to a control line disposed within a main body to drive a primary flow tube in an axially downhole direction with respect to the main body, wherein a retrievable lock mandrel is secured to the primary flow tube and an opening prong is secured to the retrievable lock mandrel such that the opening prong moves in the axially downhole direction to contact and drive a secondary flapper to an open position in response to movement of the primary flow tube in the axially downhole direction, and wherein the secondary flapper is secured to a secondary valve seat that is secured to the main body in a position downhole from the primary flow tube; and releasing pressure to the control line, wherein a spring assembly biases the primary flow tube in an axially uphole direction in response to pressure in the control line falling below the threshold pressure, wherein the opening prong is moves in the axially uphole direction to release the secondary flapper to move into a closed position in response to the primary flow tube moving in the axially uphole direction.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

The particular embodiments disclosed above are illustrative only. Although individual embodiments are discussed, all combinations of each embodiment are contemplated and covered by the disclosure. Furthermore, no limitations are intended to the details of construction or design herein shown, other than as described in the claims below. It is therefore evident that the particular illustrative embodiments disclosed above are non-exhaustive, and that other embodiments may be devise that are also within the scope of the present disclosure.

What is claimed is:

1. A subsurface safety valve system, comprising:

a tubular valve housing disposable within a wellbore;

a primary flow tube moveably secured within the valve housing between an upper position and a lower position;

a secondary valve securable within the valve housing downhole from the primary flow tube and a primary valve, wherein the secondary valve is actuatable between an open position and a closed position; and a tubular opening prong securable to the primary flow tube, wherein the tubular opening prong is moveable axially downhole to drive the secondary valve into the open position in response to the primary flow tube moving to the lower position, and wherein the tubular opening prong is movable axially uphole to release the secondary valve to move into the closed position; and an upper key assembly having at least one upper key, wherein the at least one upper key is expandable into a corresponding upper key slot formed in the primary flow tube to secure the upper key assembly to the primary flow tube, wherein the upper key is retractable from the upper key slot to release the upper key assembly from the primary flow tube, and wherein the tubular opening prong is secured to a lower end of the upper key assembly.

2. The subsurface safety valve system of claim 1, wherein the tubular valve housing comprises a main body portion and an end sub secured to a downhole end of the main body portion, and wherein the secondary valve is engageable the end sub to secure the secondary valve to the end sub of the tubular valve housing.

3. The subsurface safety valve system of claim 2, wherein the primary valve is secured within the main body portion of the tubular valve housing.

4. The subsurface safety valve system of claim 1, wherein the primary valve comprises:

a primary valve seat secured within a main body portion of the valve housing; and a primary flapper secured to the primary valve seat, wherein the tubular opening prong is configured to hold the primary flapper in an open position.

5. The subsurface safety valve system of claim 1, further comprising a fluid control line and piston disposed within the tubular valve housing, wherein the piston is moveable between a first and second position in response to fluid pressure in the fluid control line, and wherein movement of the piston from the first position to the second position drives the primary flow tube from the upper position to the lower position.

6. The subsurface safety valve system of claim 5, further comprising a spring assembly disposed in the valve housing, wherein the spring assembly is configured to bias the piston from the second position toward the first position.

7. The subsurface safety valve system of claim 1, wherein the upper key assembly comprises an upper body portion and a lower body portion, wherein the upper body portion is axially moveable with respect to the lower body portion between an extended position and a collapsed position.

8. The subsurface safety valve system of claim 7, wherein the upper body portion comprises a shim extending from a downhole end of the upper body portion, wherein the shim contacts the at least one upper key in the collapsed position to bias the at least one upper key in a radially outward direction into the corresponding upper key slot formed in the primary flow tube.

9. The subsurface safety valve system of claim 8, further comprising an upper lock feature configured to engage and hold the shim in the collapsed position, wherein the upper lock feature comprises a shear pin, a shear screw, or some combination thereof.

10. The subsurface safety valve system of claim 7, wherein the upper body portion comprises a hollow mandrel having an upper lip formed in a radially inner surface of the upper body portion, wherein the upper lip is configured to interface with a retrieval tool, and wherein the retrieval tool is configured to jar the upper body portion, via the upper lip, to shear an upper lock feature holding the upper body portion in the collapsed position.

11. The subsurface safety valve system of claim 1, wherein the secondary valve comprises:

a lower key assembly having at least one lower key, wherein the at least one lower key is expandable into a corresponding lower key slot formed in the valve housing to secure the secondary valve to the valve housing, and wherein the lower key is retractable from the lower key slot to release the secondary valve from the valve housing;

a secondary valve seat connected to a downhole end of the lower key assembly; and a secondary flapper secured to the secondary valve seat, wherein the secondary flapper is actuatable between an open position and a closed position.

12. The subsurface safety valve system of claim 11, wherein the lower key assembly comprises a shifting portion and a seal portion, wherein the seal portion comprises a mandrel and a seal secured to an outer surface of the mandrel, wherein the seal is configured to interface with the valve housing, and wherein the shifting portion is moveable axially with respect to the seal portion between an extended position and a mated position.

13. The subsurface safety valve system of claim 12, wherein the shifting portion comprises a shim extending from a downhole end of the shifting portion, wherein the shim is configured to contact the at least one lower key in the mated position to bias the at least one lower key in a radially outward direction into the corresponding lower key slot formed in the valve housing.

14. The subsurface safety valve system of claim 12, wherein the shifting portion comprises a hollow mandrel having an inner lip formed at an uphole end of the shifting portion, wherein the inner lip is configured to interface with a retrieval tool with the tubular opening prong removed from the wellbore, and wherein the retrieval tool is configured to jar the shifting portion, via the inner lip, to shear a lower lock feature holding the shifting portion in the mated position.

15. A subsurface safety valve system, comprising:

a tubular valve housing disposable within a wellbore, the valve housing having a lower key slot;

a primary flow tube axially moveable within the valve housing between an upper position and a lower position, the primary flow tube having an upper key slot formed in a radially inner surface of the primary flow tube;

a secondary valve securable within the valve housing downhole from the primary flow tube and a primary valve, wherein the secondary valve comprises a lower key assembly having a lower key configured to expand into the corresponding lower key slot formed in the valve housing to secure the secondary valve to the valve housing;

a secondary valve seat connected to a downhole end of the lower key assembly;

a secondary flapper secured to the secondary valve seat, wherein the secondary flapper is actuatable between an open position and a closed position;

an upper key assembly comprising an upper key, wherein the upper key is expandable into the upper key slot to secure the upper key assembly to the primary flow tube; and a tubular opening prong secured to a downhole end of the upper key assembly, wherein the opening prong is moveable axially downhole to drive the secondary flapper into the open position in response to the primary flow tube moving to the lower position, and wherein the opening prong is moveable axially uphole to release the secondary flapper to move into the closed position.

16. The subsurface safety valve system of claim 15, wherein the upper key assembly comprises an upper lock feature configured to hold the upper key in the corresponding upper key slot, and wherein a retrieval tool is configured to jar the upper key assembly to shear the upper lock feature and release the upper key to retract from the upper key slot, and wherein retracting the upper key is configured to release the upper key assembly and the tubular opening prong from the primary flow tube for removal from the wellbore.

17. The subsurface safety valve system of claim 16, wherein the upper key assembly comprises an upper lip formed in a radially inner surface of the upper key assembly, wherein the upper lip is configured to interface with the retrieval tool.

18. The subsurface safety valve system of claim 15, wherein the secondary valve comprises a lower lock feature configured to hold the lower key in the corresponding lower key slot, and wherein a retrieval tool is configured to jar the secondary valve to shear the lower lock feature and release the lower key to retract from the lower key slot, and wherein retracting the lower key is configured to release the secondary valve from the valve housing.

19. A method for actuating a secondary subsurface safety valve, comprising:

applying a threshold pressure to a control line disposed within a main body to drive a primary flow tube in an axially downhole direction with respect to the main body, wherein a retrievable lock mandrel is secured to the primary flow tube and an opening prong is secured to the retrievable lock mandrel such that the opening prong moves in the axially downhole direction to contact and drive a secondary flapper to an open position in response to movement of the primary flow tube in the axially downhole direction, and wherein the secondary flapper is secured to a secondary valve seat that is secured to the main body in a position downhole from the primary flow tube; and releasing pressure to the control line, wherein a spring assembly biases the primary flow tube in an axially uphole direction in response to pressure in the control line falling below the threshold pressure, wherein the opening prong is moves in the axially uphole direction to release the secondary flapper to move into a closed position in response to the primary flow tube moving in the axially uphole direction.

* * * * *